US007198260B2

(12) United States Patent
Huber et al.

(10) Patent No.: US 7,198,260 B2
(45) Date of Patent: Apr. 3, 2007

(54) METHOD FOR SYNCHRONIZING A NUMBER OF PAPER FEEDING CHANNELS OF A PAPER PROCESSING SYSTEM

(75) Inventors: Thomas Huber, Stadtbergen (DE); Helmut Foerg, Grossaitingen (DE)

(73) Assignee: Böwe Systec AG, Augsburg (DE)

( * ) Notice: Subject to any disclaimer, the term of this patent is extended or adjusted under 35 U.S.C. 154(b) by 910 days.

(21) Appl. No.: 10/148,974

(22) PCT Filed: Aug. 22, 2001

(86) PCT No.: PCT/EP01/09675

§ 371 (c)(1),
(2), (4) Date: Oct. 16, 2002

(87) PCT Pub. No.: WO02/30798

PCT Pub. Date: Apr. 18, 2002

(65) Prior Publication Data

US 2003/0112479 A1 Jun. 19, 2003

(30) Foreign Application Priority Data

Oct. 12, 2000 (DE) ..... 100 50 438

(51) Int. Cl.
*B65H 5/00* (2006.01)
*B65H 3/44* (2006.01)

(52) U.S. Cl. ..... 270/52.04; 270/1.01; 270/1.02; 270/1.03; 270/52.02; 270/52.05; 271/9.03; 700/223; 700/224

(58) Field of Classification Search ..... 271/9.03; 700/223, 224; 270/1.01, 1.02, 1.03, 52.02, 270/52.04, 52.05
See application file for complete search history.

(56) References Cited

U.S. PATENT DOCUMENTS 5,033,725 A * 7/1991 van Duursen ..... 270/52.02
5,067,088 A 11/1991 Schneiderhan (Continued)

FOREIGN PATENT DOCUMENTS

WO WO 01/28903 A1 4/2001

*Primary Examiner*—Gene O. Crawford
*Assistant Examiner*—Leslie A. Nicholson, III
(74) *Attorney, Agent, or Firm*—Martin Fleit; Paul D. Bianco; Fleit Kain Gibbons Gutman Bongini & Bianco P.L.

(57) ABSTRACT

The invention relates to a method for automatically synchronizing a number of paper feeding channels of an inserting system involving the following steps: a) inspecting the sheets provided for output in one of the channels by comparing their group sequence number and their sheet sequence number with predetermined reference values; b) outputting the inspected sheets from this channel if their group sequence number and sheet sequence number correspond with the set reference values; c) inspecting the additional sheets provided for output in one or more additional channels if the group sequence number or the sheet sequence number of a previously inspected sheet does not correspond with the set reference values; d) outputting the sheets from the additional channels if their group sequence number and sheet sequence number correspond with the set reference values, and; e) identifying a group as a defective group and outputting the sheet with the smallest group sequence number and with the smallest sheet sequence number if none of the inspected sheets have the set reference group sequence number and reference sheet sequence number.

10 Claims, 2 Drawing Sheets

U.S. PATENT DOCUMENTS 5,510,997 A * 4/1996 Hines et al. ..... 700/224
5,608,639 A * 3/1997 Twardowski et al. ..... 700/125
5,732,939 A 3/1998 Meier
5,734,566 A 3/1998 Stengl
5,838,574 A 11/1998 Olson et al.
5,915,089 A 6/1999 Stevens et al.
6,049,637 A * 4/2000 Kosarew et al. ..... 382/321
6,304,795 B1 * 10/2001 Reist ..... 700/219
6,347,260 B1 * 2/2002 Graushar et al. ..... 700/223
6,767,011 B2 * 7/2004 Kavanagh ..... 270/52.02
6,968,783 B2 * 11/2005 Hug et al. ..... 101/484
7,024,274 B2 * 4/2006 Johansson ..... 700/223
7,114,231 B2 * 10/2006 Benaglio et al. ..... 29/407.1

* cited by examiner

METHOD FOR SYNCHRONIZING A NUMBER OF PAPER FEEDING CHANNELS OF A PAPER PROCESSING SYSTEM

FIELD OF THE INVENTION

The invention concerns a method for automatic synchronization of several paper-feeding channels of a paper processing system, that can be used, for example, in an inserting system.

BACKGROUND OF THE INVENTION

This type of method is required, for example, in inserting systems with a number of paper-feeding channels for automatic compiling of, for example, electricity, gas, water and telephone bills or also account and deposit statements (for example, CH 675853 A5). In an inserting system equipped with two channels, a first channel can contain the cover letter or the address carrier and the second channel the individual listing. The groups situated in the channels can each consist of several sheets. In order to achieve a desired compilation, the feeding from the corresponding channels must be controlled and synchronized accordingly. In the usual inserting systems, group formation in the individual channels is generally carried out. The completeness of the individual groups is then checked from the individual channels, wherein it is determined whether all individual sheets of a group and a feature for marking the end of a group are present. Before combining the groups, it must then additionally be checked by means of a correlation feature whether the corresponding groups are correlated. To permit these individual process steps, features for consistency testing and marking for selective or constant channel call-up must generally be present in addition to the information features for marking of a sheet sequence and group sequence number as well as an end of group per channel. However, this method is relatively time-consuming and prone to error. In the usual control method, the automatic process is also interrupted in the case of an error in checking of the sheet sequence, group sequence, consistency or channel call-up, caused, for example, by a reading error, product removal or paper jam and manual synchronization of all partial channels by the operator is required. A greater demand for operating personnel therefore exists in such inserting systems and the effective output of the system is lower.

SUMMARY OF THE INVENTION

An object of the invention is to devise a method for the control of a paper processing system of the initially mentioned type that makes possible the simplest, most functionally reliable and most effective combining of products from several channels.

The invention relates to a method for automatically synchronizing a number of paper feeding channels of an inserting system involving the following steps: a) inspecting the sheets provided for output in one of the channels by comparing their group sequence number and their sheet sequence number with predetermined reference values; b) outputting the inspected sheets from this channel if their group sequence number and sheet sequence number correspond with the set reference values; c) inspecting the additional sheets provided for output in one or more additional channels if the group sequence number or the sheet sequence number of a previously inspected sheet does not correspond with the set reference values; d) outputting the sheets from the additional channels if their group sequence number and sheet sequence number correspond with the set reference values, and; e) identifying a group as a defective group and outputting the sheet with the smallest group sequence number and with the smallest sheet sequence number if none of the inspected sheets have the set reference group sequence number and reference sheet sequence number.

The method according to the invention is characterized by a particularly simple and effective process. Several channels can be automatically synchronized and processed for arbitrary group composition without operator intervention. Each channel can be the guide channel, i.e., the channel with the first sheet sequence number. A fully freely configurable group of arbitrary channels is obtained for the user. In addition, the user need not distinguish between single and multichannel jobs. A significant advantage of the control method also consists of the fact that processing continues even during malfunctions. During an error only one group is influenced, which can be sorted out, as required, and supplemented manually.

BRIEF DESCRIPTION OF THE DRAWINGS

Additional details and advantages of the invention are apparent from the following description of an embodiment example with reference to the drawing. In the drawing.

DETAILED DESCRIPTION OF THE INVENTION

Figure 1:
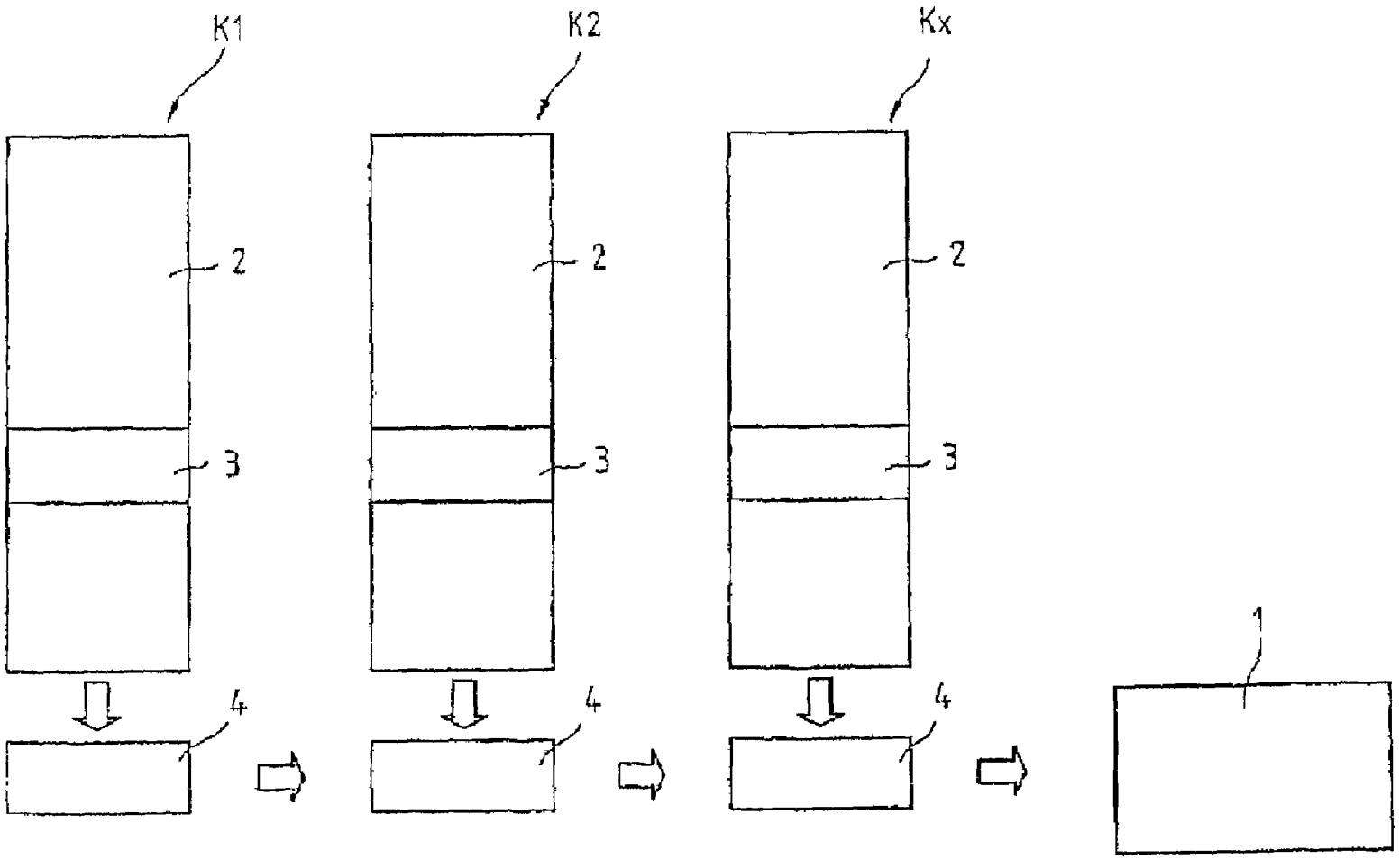
FIG. 1 shows a schematic view of an inserting system with several channels and FIG. 2 shows a process diagram of a method according to the invention for controlling an inserting system with two channels.

The inserting system shown schematically in FIG. 1 contains an inserting machine 1, into which sheets fed from several channels K1 to Kx and assembled into a desired group are inserted and correspondingly released for sending. Each channel K1 to Kx contains a feeding device 2, a reading device 3 to record data present on the sheets and a corresponding selection station 4 at which the fed sheets are collected for further transport to the inserting machine 1.

Each sheet contains corresponding data or information for marking of the affiliation of the sheet to a specific group, data for marking the sheet sequence within a group and additional data indicating whether the sheet is a last sheet or a continuation sheet of a group. These data can be applied, for example, by means of a bar code, a 2D code or another appropriate coding on the sheets. The group sequence number can consist, for example, of a six-digit sequence (GRPFLG=0000000–999999) and the sheet sequence number of a two-digit sequence (BLTFLN=00–99). Marking of a still running group or the group end (GRE) can occur in the form of a bit (0=running sheet and 1=group end).

An example for the sheets arranged in the two channels of a two-channel system with the data or information located on them is shown in the following table.

| Group (insert) | Channel K1 group sequence | Sheet sequence | Channel K2 group sequence | Sheet sequence |
|---|---|---|---|---|
| 1 | 000001 | 01 | | |
| 1 | 000001 | 02 | | |
| 1 | | | 000001 | 03 |

-continued

| Group (insert) | Channel K1 group sequence | Sheet sequence | Channel K2 group sequence | Sheet sequence |
|---|---|---|---|---|
| 1 | 000001 | 04 | | |
| 1 | | | 000001 | 05 + GRE |
| 2 | 000002 | 01 | | |
| 2 | 000002 | 02 | | |
| 2 | 000002 | 03 + GRE | | |
| 3 | 000003 | 01 | | |
| 3 | | | 000003 | 02 |
| 3 | | | 000003 | 03 + GRE |
| 4 | 000004 | 01 + GRE | | |

The first sheet in channel K1 carries the group sequence number 000001 and the sheet sequence number 01. This sheet therefore represents the first sheet of a first group. The second sheet situated in channel K1 contains the group sequence number 000001 and the sheet sequence number 02 and is therefore the second sheet belonging to the first group. The third sheet marked with group sequence number 000001 and sheet sequence number 03 of the first group, on the other hand, is arranged in channel K2, whereas the fourth sheet of the first group is found again in channel K1. The sheet arranged in channel K2 with the group sequence number 000001 and the sheet sequence number 05 also carries an end-of-group mark and therefore represents the last sheet belonging to the first group.

These data from all channels K1 to Kx are reported, for example, to a collecting station arranged in front of the inserting machine 1 to which all the previous channels are connected. Based on the information found on the sheets, the collecting station can decide from which channel the next product is to be processed. Since a sheet sequence exists within each group, a next sheet can be clearly identified and collected. The group end at the end of an entire group closes the group.

Figure 2:
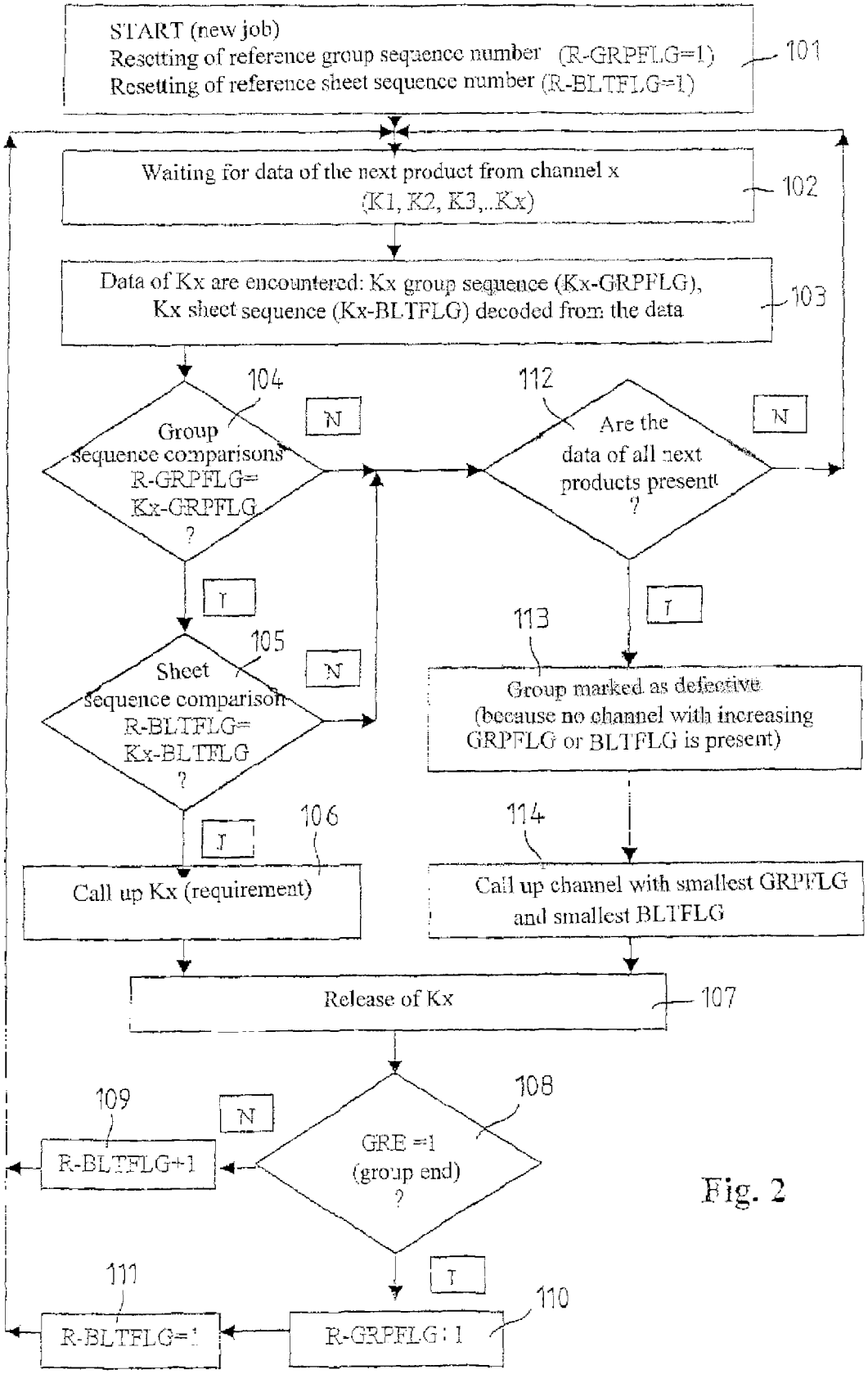

A simple control process for automatic combining of sheets from several channels is explained below with reference to the flow chart shown in FIG. 2.

On starting the control process according to the invention, a reference group sequence number and a reference sheet sequence number are initially reset in a first step 101 to an initial reference value 1. It is then waited in a next step 102 until at least the data of a first sheet are available from one of the channels. As soon as the presence of these data is recognized in a subsequent step 103 and the group sequence number and sheet sequence number corresponding to the corresponding sheet are decoded, a group sequence comparison occurs in a next step 104, in which it is determined whether the group sequence number of this sheet corresponds with the reference group sequence number.

When the group sequence number of the checked sheet agrees with the reference group sequence number, a sheet sequence comparison is conducted in a next step 105. It is then determined whether the sheet sequence number of the checked sheet corresponds with the reference sheet sequence number. If this is the case, the corresponding channel is called up in a next step 106 and the checked sheet is released, for example, for transport to a collecting station in a next step 107.

The released sheet is also inspected in another step 108 to determine whether it already carries an end-of-group mark and therefore is the last sheet of a group. If this is not the case, the reference sheet sequence number is increased by the value 1 in an additional step 109 and the inspection of the next sheet is continued in step 102. However, if the check conducted in step 109 shows that the corresponding sheet already carries the end-of-group mark, the reference group sequence number is increased by the value 1 in a next step 110 and the reference sheet sequence number is reset to the value 1 in a subsequent step 111. The group is therefore complete and can be released, for example, for transport to an inserting machine.

However, when the group sequence comparison conducted in step 104 shows that the group sequence number of the checked sheet does not correspond with the reference group sequence number, it is determined in a next step 112 whether the data of the next sheet are already present from the additional channels. If this is not the case, a return to step 102 is carried out and it is initially waited until all data are available and are correspondingly decoded in step 103. The group sequence comparison according to step 103 is then carried out on the next sheets of the additional channels. As soon as one of the determined sheets has a group sequence number corresponding to the reference group sequence number, a sheet sequence comparison is again carried out in the following step 105 and it is checked whether this sheet carries a sheet sequence number corresponding to the reference sheet sequence number. If this is the case, the process is continued with step 106.

However, if the check conducted in step 112 shows that the data of all the next sheets are already present, this group is marked as incorrect in a step 113 and the channel with the smallest group sequence number and smallest sheet sequence number is called up in the next step 114.

Even if the sheet sequence comparison conducted in step 105 shows that the sheet sequence number of the checked sheet does not correspond with the reference sheet sequence number, it is initially inquired in step 112 whether all the data of the additional channels are already present. Thus, it can be determined whether the next sheet belonging to a specific group is located in one of the additional channels. If all data of the next sheets are present and the desired agreement with the corresponding reference values is not determined in the conducted group or sheet sequence comparison, the corresponding group is marked incorrect in step 113 and the channel with the smallest group sequence number and the smallest sheet sequence number is called up in step 114 for release of the corresponding sheet.

The process is then continued with the new reference values.

For the sake of simplicity, the process just explained will now be explained with reference to an example shown in the above table for automatic compiling of a sheet sequence in an inserting system with two channels K1 and K2. However, it must be expressly pointed out that the method is also suitable for a system with more than two channels.

In the example shown in the table, after resetting of the reference group sequence number and the reference sheet sequence number to the value 1 at the start of the process, initially one begins with checking the sheet 1 from channel K1. After the data of the first sheet from channel K1 are present and the group sequence and sheet sequence numbers applied to the sheet are decoded accordingly, the group sequence number of the first sheet is initially checked in step 104. Since the first sheet located in channel K1 has the group sequence number corresponding to the reference group sequence number, its sheet sequence number is compared in the next step 105 with the reference sheet sequence number. The sheet sequence number on the first sheet in channel 1 also agrees in the example with the reference sheet sequence number set to a value of 1 in step 101. Channel K1 is therefore called up in the next step 106 and the first sheet is released, for example, for transport to a collecting station in step 107. It is then determined in step 108 whether the first sheet already bears the end-of-group mark. However, in the first sheet of the example shown in the table, this is not the case; thus, the reference sheet sequence number is increased by the value 1 in the next step 109 and the process is continued for checking the next sheet in step 102.

Since the next sheet in channel K1 has the group sequence number corresponding to the reference group sequence numbers and the new reference sheet sequence number increased by the value 1 in step 109, channel K1 is called up again in step 106 after the group and sheet sequence comparison conducted in steps 104 and 105, and the second sheet in channel K1 is released in the next step 107, for example, for placement on the first sheet. The second sheet in channel K1 also still does not bear the end-of-group mark, so that the reference sheet sequence number is again increased by the value 1 in step 109 and the process is continued with checking of the next sheet in channel K1 according to step 102.

The third sheet in channel 1 does have the reference group sequence number set to a value of 1 in step 101, but not the new reference sheet sequence number increased by the value 1 in step 109. At the end of the sheet sequence comparison according to step 105, it is therefore initially checked in step 112 whether the data of the next sheet pending release from channel K2 are also present. If this is not the case, process control returns to step 102 and the arrival of the data of the next sheet from channel 2 is awaited. As soon as the data of the next sheet from channel K2 arrives, its group and sheet sequence number are compared with the corresponding reference values. The next sheet in channel 2 in the depicted example has the group sequence number 000001 and the sheet sequence number 03, so that channel K2 is called up and the sheet is released to be placed on the two previous sheets. Since this sheet also still does not bear the end-of-group mark, the reference sheet sequence number is again increased by the value 1, and checking of the next sheet is continued in step 102.

During subsequent checking of the next sheet in channel K2 during the sheet sequence comparison conducted in step 105, a deviation also occurs from the newly set reference sheet sequence number, so that channel K1 is again called up. In the next sheet located in channel K1, the group sequence number agrees with the initially established reference group sequence number and the sheet sequence number with the new reference sheet sequence number, in which case channel K1 is called up and the corresponding sheet is released. This sheet still does not have the end-of-group mark either, so that the reference group sequence number is again increased by the value 1.

The next checked sheet in channel K1 does not have the required reference group sequence numbers, so that channel K2 is again called up via step 112. In the next sheet to be released there, the group sequence number agrees with the reference group sequence number and the sheet sequence number also agrees with the new reference sheet sequence number, so that channel K2 is called up and the corresponding sheet is released. Since this sheet also carries the end-of-group mark, the reference group sequence number is increased by the value 1 in the next step 110 and the reference sheet sequence number is reset to the value 1 in step 111 before checking of the next sheet is continued in step 102. The now complete group 1 can then be transported to the inserting machine and further processed accordingly.

If, in the example shown in the table, the first sheet marked with the group sequence number 000001 and the sheet sequence number 03 is missing in channel K2, the check conducted after the second sheet from channel K1 shows that the next sheet in channel K1 does have the group sequence number corresponding to the reference group sequence number, but not the required sheet sequence number. During further checking of the next sheet from channel K2 during the sheet sequence comparison, no agreement with the reference sheet sequence number is found either. The corresponding group is therefore marked as incorrect in step 113 and the channel with the smallest group sequence number and the smallest sheet sequence number is called up. In the present example, this is channel K1, whose next sheet has the group sequence number 000001 and the sheet sequence number 04. This group marked as incorrect can either be separated or made up by hand.

It is apparent from the foregoing that in the described process the automatic inserting process can be continued even if a malfunction occurs in one of the channels. The additional groups can also be automatically processed during malfunctions in the preceding group.

Several collecting stations can be used to increase time performance without altering the process. Channel K1 in the preceding example can then carry out precollection, if the sheet sequence is increasing (n+1) and the same group sequence number is present. This channel then releases the precollected number of pieces and the last sheet sequence number to the second collecting station. The second collecting station then knows from the sheet sequence number and the number of sheets which channel must be processed first.

The invention claimed is:

1. Method for automatic synchronization of a number of parallel paper-feeding channels of a paper processing system, such as an inserting system and the like, the method comprising the steps of:

a) placing a reference group sequence number that increases from group to group and a reference sheet sequence number that increases within a group from sheet to sheet;

b) recording a group sequence number arranged on the corresponding sheet, a sheet sequence number and a statement for marking of a continuing or last sheet of a group being assembled;

c) inspecting the sheets ready for release in one of the parallel paper-feeding channels by comparison of the group sequence number and the sheet sequence number with the set reference values;

d) releasing the inspected sheets from this channel when the group sequence number and sheet sequence number correspond to the set reference values;

e) inspecting additional sheets ready for release in one or more additional parallel paper-feeding channels when the group sequence number or the sheet sequence number of a previously inspected sheet does not agree with the set reference values;

f) releasing the sheets from additional parallel paper-feeding channels when the group sequence number and sheet sequence number correspond to the set reference values; and g) marking a group as a defective group and release of the sheet with the smallest group sequence number and the smallest sheet sequence number when none of the inspected sheets has the set reference group sequence number and reference sheet sequence number.

2. Method according to claim 1 wherein the reference sheet sequence number is increased by the value 1 when a released sheet bears a mark of a continuation sheet and wherein the reference group sequence number is increased by the value 1 and the reference sheet sequence number is set to an initial value when a released sheet has an end-of-group mark.

3. Method according to claim 1 wherein the reference group sequence number and the reference sheet sequence number are initialized to 1.

4. Method according to claim 1 wherein arrival of corresponding data is awaited before comparison of the group sequence number and the sheet sequence number with the corresponding reference values.

5. Method according to claim 1 wherein the group sequence number and the sheet sequence number are applied to the sheets in the form of a bar code or 2D code and are decoded before comparison with the corresponding reference group sequence number or reference sheet sequence number.

6. Method according to claim 1 wherein the groups marked as defective are sorted out.

7. Method according to claim 1 wherein a group is released for transport to an inserting machine when the information for an end-of-group mark is recorded.

8. A method for synchronizing at least two parallel paper-feeding channels in a paper processing system for producing a plurality of groups, each group comprising at least one sheet, wherein each of the channels feeds respective sheets, each sheet comprising a group sequence number and a sheet sequence number, wherein the group sequence number is initially set to a first reference value which is incremented once a group is completed, and wherein the sheet sequence number is initially set to a second reference value which is incremented once a sheet is released by one of the parallel paper-feeding channels, the method comprising:

(a) detecting from a sheet provided by a first paper-feeding channel the group sequence number and the sheet sequence number;

(b) comparing the detected group sequence number to the first reference value and the detected sheet sequence number to the second reference value;

(c) releasing the sheet from the first paper-feeding channel when the detected group sequence number and the first reference value match, and when the detected sheet sequence number and the second reference value match; and (d) when the detected group sequence number and the first reference value do not match, and when the detected sheet sequence number and the second reference value do not match:

(d.1) detecting from a sheet provided by a second parallel paper-feeding channel the group sequence number and the sheet sequence number, (d.2) comparing the detected group sequence number to the first reference value and the detected sheet sequence number to the second reference value, (d.3) releasing the sheet from the second paper-feeding channel when the detected group sequence number and the first reference value match, and when the detected sheet sequence number and the second reference value match, (d.4) when the detected group sequence number and the first reference value do not match, and when the detected sheet sequence number and the second reference value do not match, marking the group currently produced defective, and (d.5) releasing the sheet having the smallest group sequence number and the smallest sheet sequence number from the parallel paper-feeding channels.

9. The method of claim 8, wherein each sheet further comprises a marking indicating whether the sheet is a last sheet of a group or whether the sheet is a continuation sheet of the group, wherein the second reference value is incremented when the sheet released comprises a marking indicating that the sheet is a continuation sheet, and wherein the first reference value is incremented and the second reference value is reset to an initial value when the sheet released comprises a marking indicating that the sheet is the last sheet of the group.

10. The method of claim 9, wherein released sheets are collected and transported to an inserting machine when the latest sheet released comprises the marking that the sheet is the last sheet of the group.

* * * * *